US005918684A

United States Patent [19]

Tozer

[11] Patent Number: 5,918,684

[45] Date of Patent: Jul. 6, 1999

[54] DEVICE FOR COLLECTION OF DEBRIS

[75] Inventor: Warwick Tozer, Eltham, Australia

[73] Assignee: Aero-Tech Pty. Ltd, Australia

[21] Appl. No.: 08/809,249

[22] PCT Filed: Sep. 22, 1995

[86] PCT No.: PCT/AU95/00629

§ 371 Date: Jun. 3, 1997

§ 102(e) Date: Jun. 3, 1997

[87] PCT Pub. No.: WO96/09440

PCT Pub. Date: Mar. 28, 1996

[30] Foreign Application Priority Data

Sep. 22, 1994 [AU] Australia ..... PM8324
Feb. 8, 1995 [AU] Australia ..... PN0969

[51] Int. Cl.[6] ..... E01H 1/00; A63B 47/02

[52] U.S. Cl. ..... 172/199; 172/29; 172/612

[58] Field of Search ..... 56/328.1; 171/63, 171/105, 141, 144; 172/29, 189, 197, 198, 199, 445.1, 612, 684.5

[56] References Cited

U.S. PATENT DOCUMENTS

| | | | |
|---|---|---|---|
| 1,448,385 | 3/1923 | Bryant . | |
| 1,997,248 | 4/1935 | Densberger | 172/612 X |
| 3,010,523 | 11/1961 | Gifford | 56/328.1 X |
| 4,747,174 | 5/1988 | Hightower | 15/78 |
| 5,018,587 | 5/1991 | Gandrud et al. | 172/612 |
| 5,284,211 | 2/1994 | Tozer | 172/199 X |
| 5,305,834 | 4/1994 | White | 171/63 |

FOREIGN PATENT DOCUMENTS

| | | |
|---|---|---|
| 876-521 | 9/1979 | Belgium . |
| 26 33 215 | 1/1978 | Germany . |
| 6-15064 | 1/1994 | Japan . |
| WO 90 13712 | 11/1990 | WIPO . |

*Primary Examiner*—Thomas B. Will
*Assistant Examiner*—Robert Pezzuto
*Attorney, Agent, or Firm*—Seed and Berry LLP

[57] ABSTRACT

A device for collecting debris from a surface. The device has a generally planar matting material the undersurface of which is formed with depending bristles. The device has an opening therethrough whereby when the device is moved over a ground surface with the bristles in contact therewith, debris on the ground surface is passed through the opening to rest on the matting material.

28 Claims, 8 Drawing Sheets

DEVICE FOR COLLECTION OF DEBRIS

TECHNICAL FIELD

This invention relates to a device for collection of debris.

BACKGROUND OF THE INVENTION

U.S. Pat. No. 5,284,211 discloses a ground surface debris collection device suitable, for example, for collecting small debris such as leaves from a ground surface. This comprises a device of flexible grid like construction having slots so that, as the device is moved over the ground surface, debris passes through the slots and onto the upper surface of the device.

While the arrangement shown in U.S. Pat. No. 5,284,211 has been found to be very satisfactory in use, particularly for grooming and cleaning tennis court surfaces, it has now been found it is not efficient as is desirable on rougher surfaces such as rough asphalt.

SUMMARY OF THE INVENTION

In one aspect, the invention provides a device for collecting debris from a surface, comprising a generally planar member having at least a portion thereof defining an undersurface of the device formed of a conformable material such that when the device is moved over a ground surface with the undersurface in contact with the ground surface the undersurface is caused to locally conform to undulations in the ground surface, the device having an opening, whereby, under said movement over a ground surface, debris on the ground surface passes through the opening onto an upper surface of the device. The opening may be formed in or adjacent the conformable material.

The aforementioned portion may be formed from a flexible layer, such as of foam plastics material, or an open mat of sinuous fibres, such as open looped fibres. In a preferred form, however, the conformable material comprises a brush-like structure. The planar member may include a backing portion which may be flexible or may be relatively rigid.

In another aspect, the invention provides a device for collecting debris from a surface, comprising a generally planar member having at least a portion thereof defining an undersurface of the device formed with depending bristles thereover and the device having an opening therethrough whereby when the device is moved over a ground surface with the bristles in contact therewith debris on the ground surface is passed through the opening to an upper surface of the device.

The opening may have at a rear edge thereof a forwardly and downwardly depending surface to facilitate pick up of debris. Also, to assist in retention of debris on the device, the device may be fitted at its upper surface with upstanding projections ridges or the like. For example, an upstanding wall may be formed along the front edge of the opening and/or at one or both side edges of the opening.

There may be a single opening, but it is preferred that there are a number of openings.

In a still further aspect, the invention provides a device for collecting debris from a surface, comprising a generally planar member having an opening through the generally planar member whereby, under said movement over a ground surface, debris on the ground surface passes through the opening onto an upper surface of the device, the device having means for entrapping debris having passed through the opening. The entrapping means may comprise a mesh material. The material forming the entrapping means may comprise material which forms a cavity over the upper surface of the generally planar member. Otherwise, the device may for example bc constructed as above described. Alternatively, it may bc for example be constructed in accordance with the teachings of the above-mentioned U.S. Pat. No. 5,284,211, the disclosures of which are hereby incorporated to form part of the present specification.

BRIEF DESCRIPTION OF THE DRAWINGS

The invention is further described by way of example only with reference to the accompanying drawings in which.

DETAILED DESCRIPTION OF THE INVENTION

Figure 1:
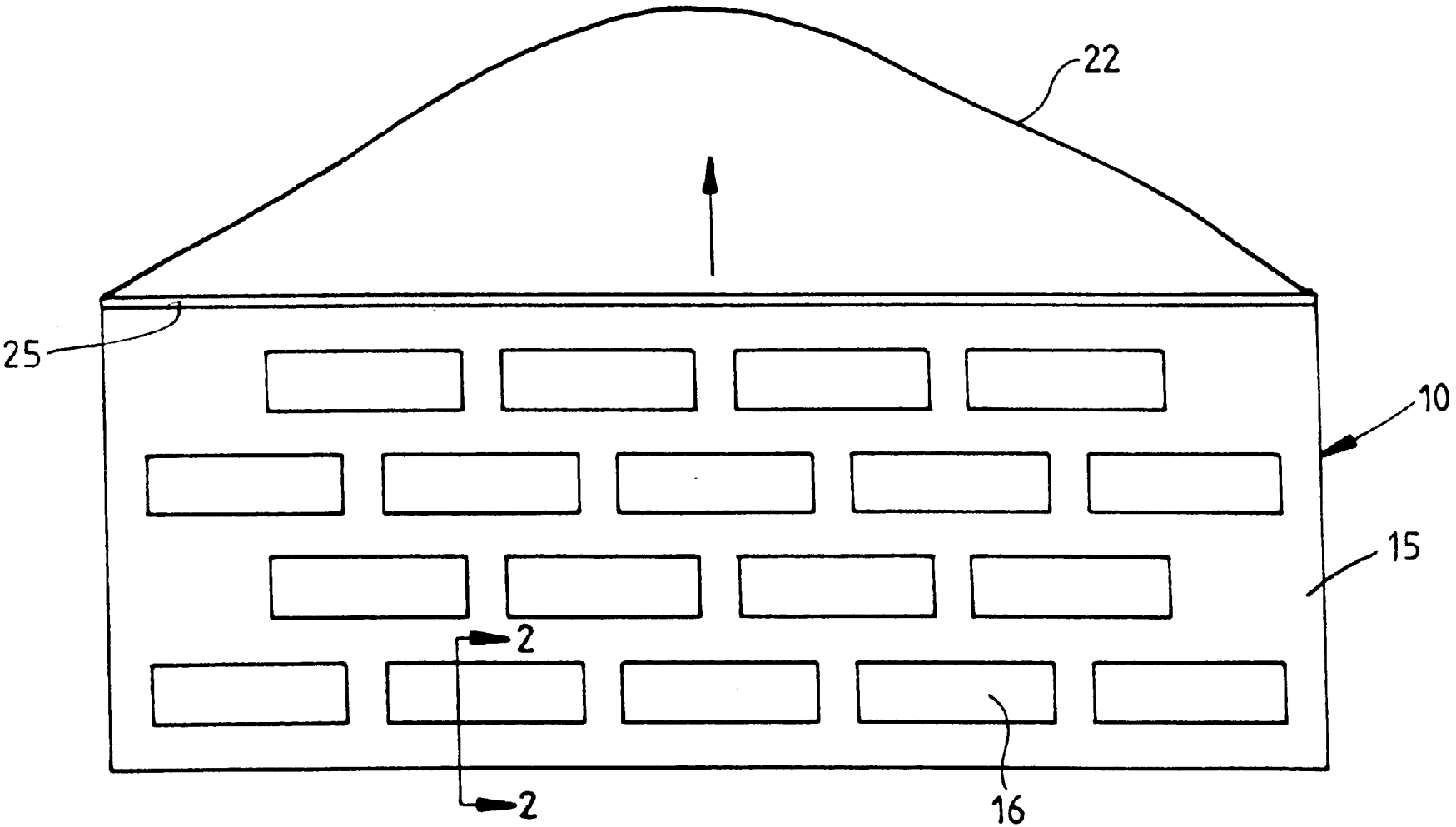
FIG. 1 is a plan view of device constructed in accordance with the invention.
Figure 2:
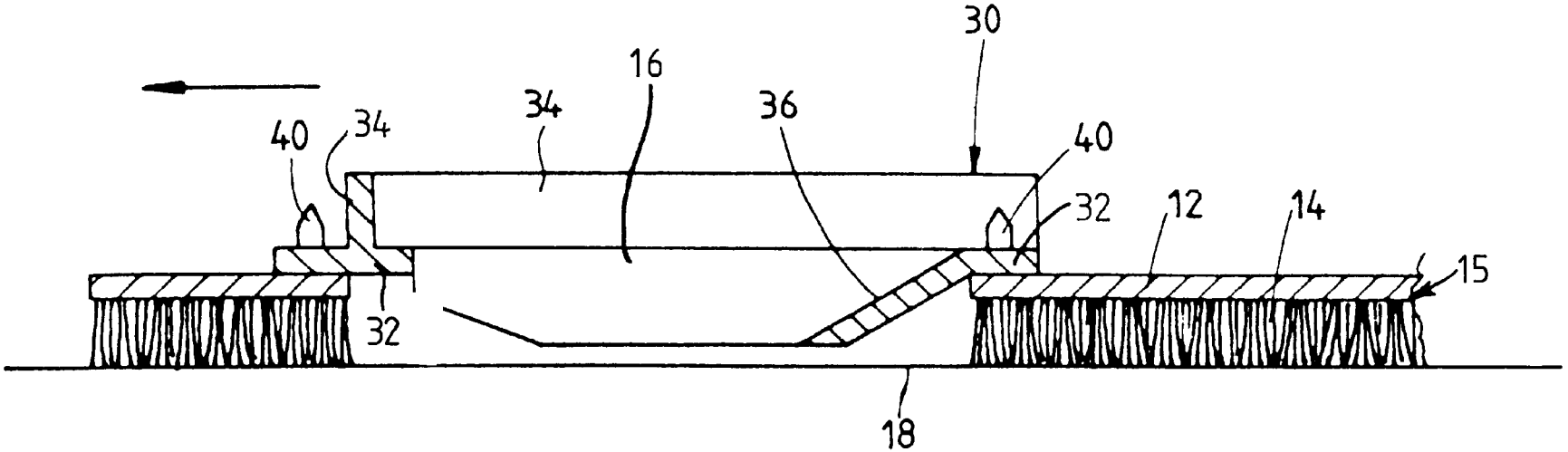
FIG. 2 is an enlarged cross-section on the line 2—2 in FIG. 1.
Figure 3:
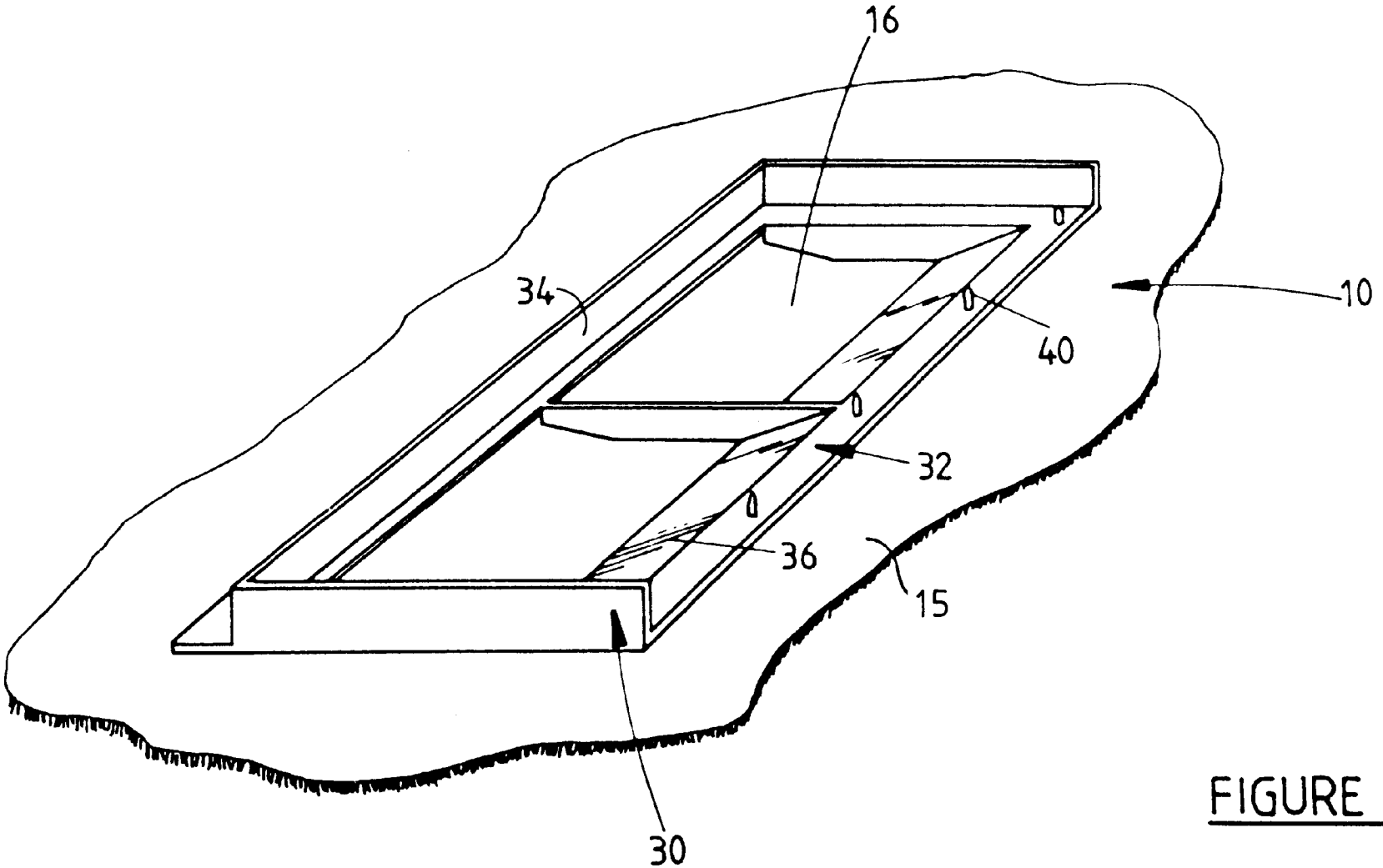
FIG. 3 is an enlarged perspective view of a reinforcing frame incorporated into the device of FIG. 1.

Referring firstly to FIGS. 1, 2 and 3, the device shown therein is formed of a conformable matting material 15 having, as shown in FIG. 2, a flexible laminar base portion 12 with depending bristles 14. It has been found convenient to form the device from inverted artificial grass material of the kind used for the surfaces of tennis courts and the like, arranged with the bristles extending downwardly. Generally, the material 15 should be flexible.

The matting material 15 has a series of rectangular sidewardly elongate openings 16 arranged in transversely extending spaced rows. When the device 10 is moved over a ground surface 18 (FIG. 2), such as by towing by use of the rope 22 (FIG. 1) at a forward end thereof, the bristles 14 agitate leaves, stones and the like on the ground surface by contact therewith and this debris tends to pass from the underside of the device 10 through the openings 16 to rest on upper portions of the device 10 and on the base portion 12 between the openings 16. The debris so resting on the upper side of the device 10 can be then conveniently taken away on the device for disposal as desired. The bristles act to "flick" material into the openings 16.

In the particular form shown in FIGS. 2 and 3, each opening 16 is surrounded by a reinforcing frame 30. The frame has a peripheral edge portion 32 which at front and side portions of the opening 16 is formed with an upstanding wall 34. At the rear edge, the frame is formed with a downwardly angled edge pickup portion 36 which extends from a location at the upper side of the matting material 15 forwardly and downwardly to terminate at a location which in use of the device 10 is only just above the ground surface 18. The frame is secured in position on the matting material 15 by use of bolts or other fixture elements 40, which extend through the frame and the matting material 15. Alternatively, the frame may be stitched to the matting material.

Figure 4:
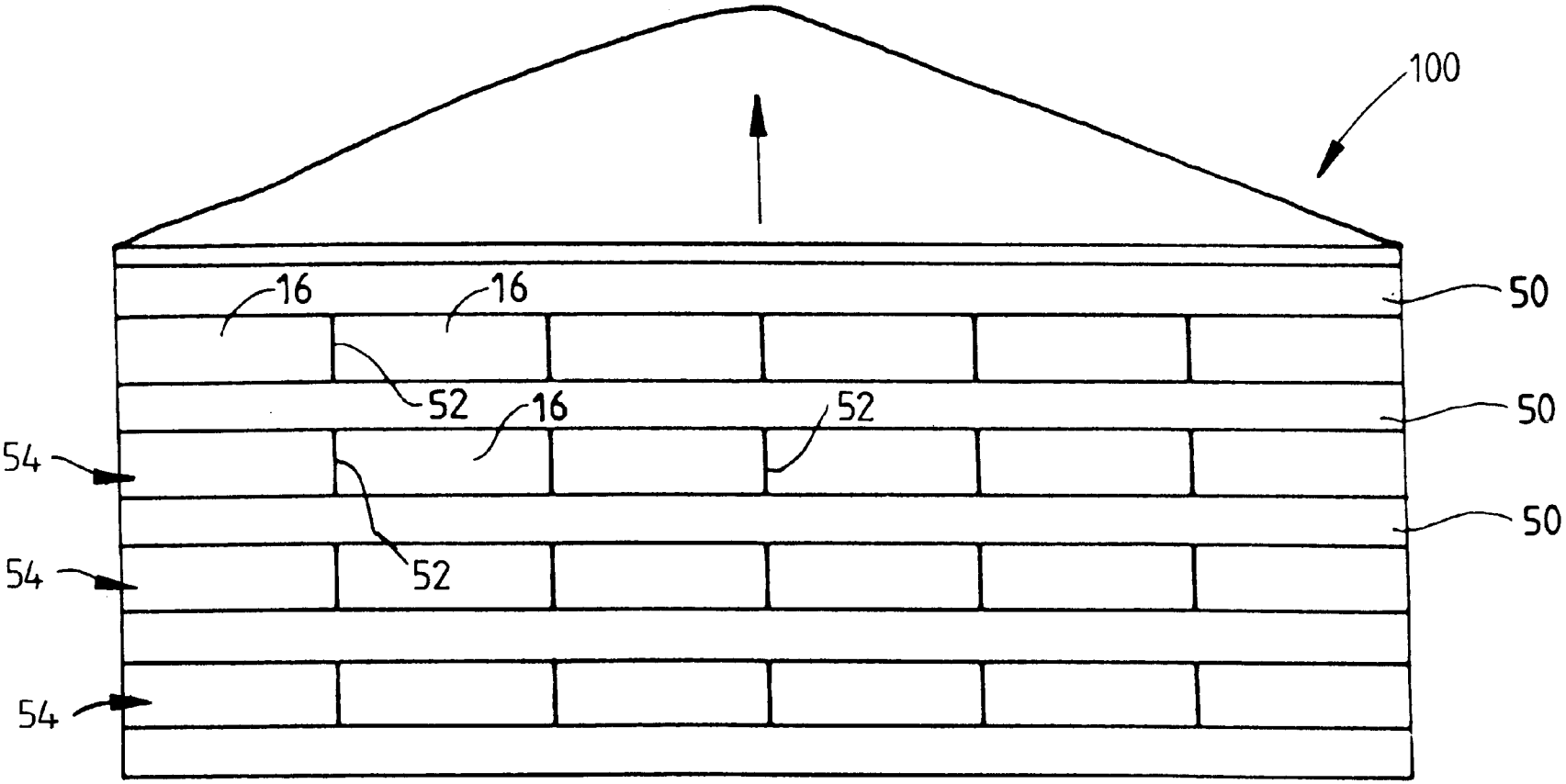
FIGS. 4 and 5 are plan views of two further embodiments of the invention.

In device 100 of FIG. 4, the openings 16 are formed between side to side extending strips 50 of matting material 15 with relatively narrow forward to rearwardly extending connector elements 52 interconnecting the strips. Thus, each set of side by side aligned openings forms a substantially continuous side to side aperture 54.

Figure 5:
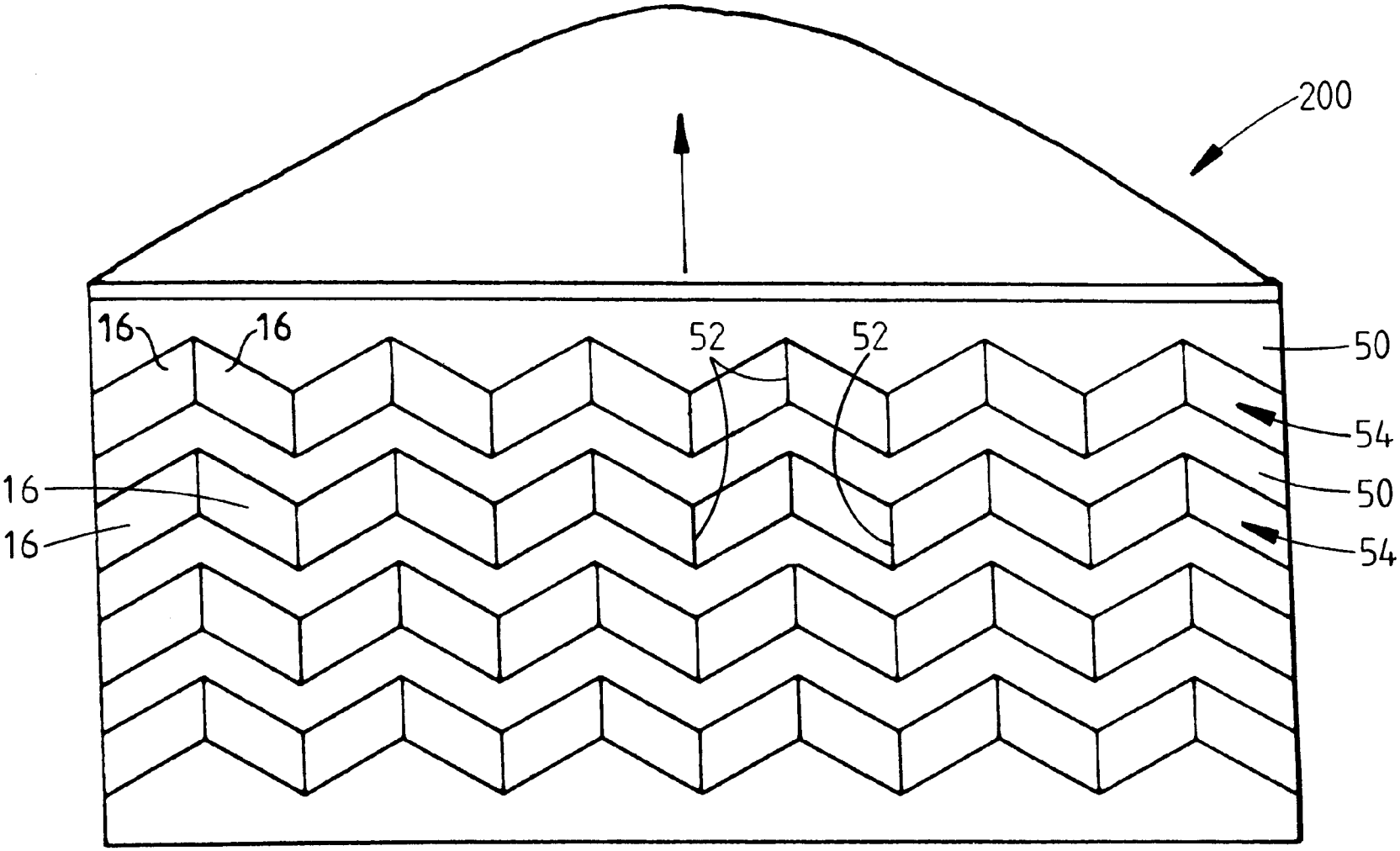

The device 200 of FIG. 5 is generally similar to that of FIG. 4, save that the side to side extending apertures 54 are of "saw tooth" configuration. Alternate openings 16 in each side to side extending aperture 54 are angled forwardly and rearwardly as shown.

Figure 6:
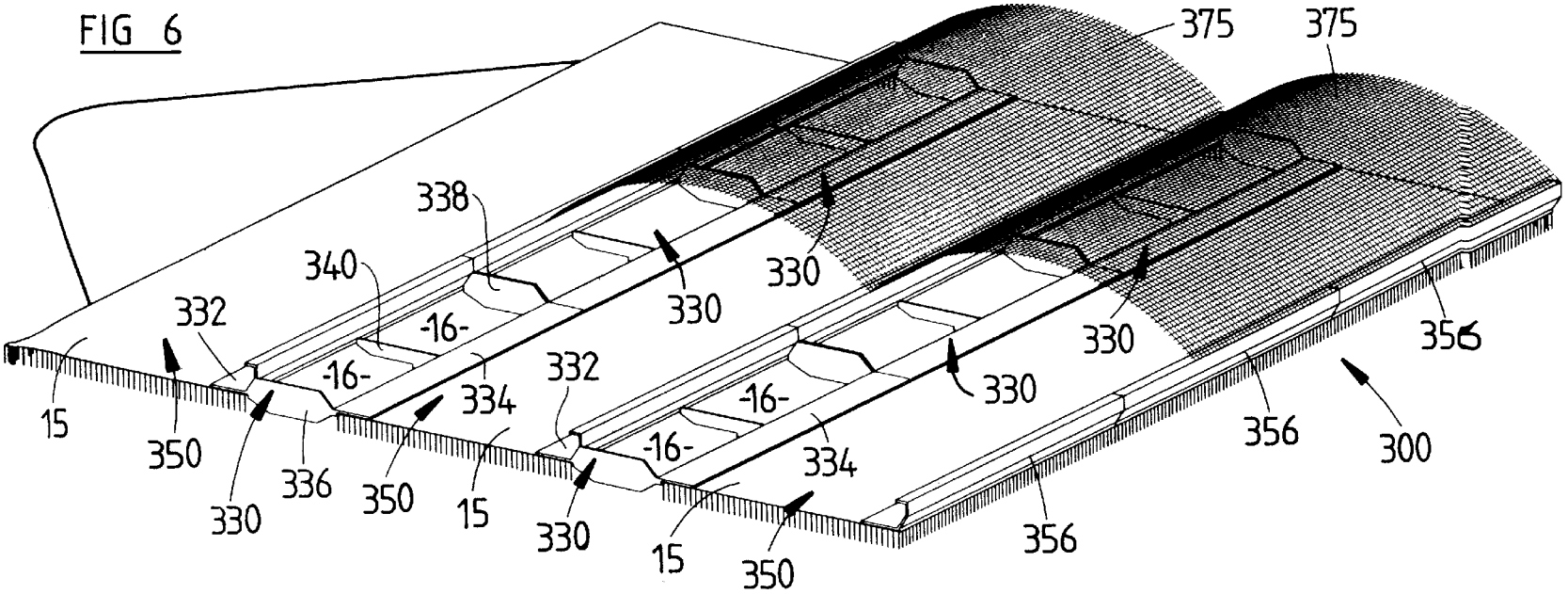
FIG. 6 is a perspective view of another embodiment of the invention.
Figure 7:
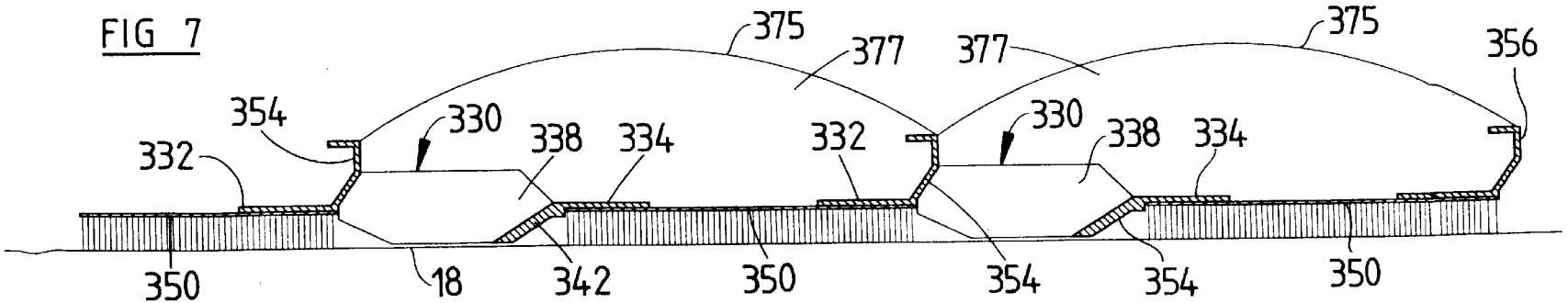
FIG. 7 is a side to side cross-section of the embodiment of FIG. 6.
Figure 12:
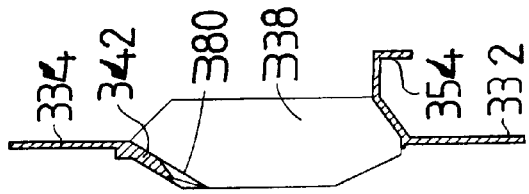
FIGS. 11 and 12 are respective cross-sections on the lines 11—11 and 2—12 in FIG. 8.
Figure 11:
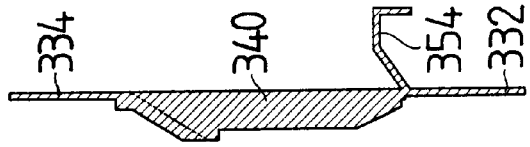

The device 300 of FIGS. 6 and 7 has side to side extending strips 350 formed from matting material 15 and interconnected by plastics frames 330. In this case there are three strips 350 interconnected by two sets of the frames 330, with each set of frames comprising three sidewardly aligned frames. Each frame 330 comprises a forward generally planar horizontally extending portion 332 and a rear planar generally horizontally extending portion 334, co-planar with portion 332. Portion 332, 334 are connected at ends of each frame 330 by end walls 336, 338 and by an intermediate wall 340. Walls 330, 338, 340 are generally planar and vertically extending, and of relatively small thickness in the side to side direction of the device 300, so that each frame presents two relatively large side by side openings 16.

The three front frames 330 in each set are in closely adjacent side by side relationship so as to provide, across the width of the device 10, six openings 16. Each portion 334 has a forwardly and downwardly inclined pick-up portion 342 which extends downwardly to a location adjacent to ground surface 18 (FIG. 7). This functions in a similar manner to the downwardly angled pick-up portion 36 previously described.

At the rear of each frame portion 332, there is an upwardly extending wall portion 354, these being arranged, for each set of frames, so as to present a substantially continuous wall extending from side to side of the device 300.

Three end pieces 356 are provided in end to end abutting relationship across the width of the device 10 at the rear edge of the rear one of the three strips 350. These define an upstanding side to side extending wall similarly configured to the walls provided by the side to side wall portions 354 associated with the two frames 330.

Fine mesh screens 375 having some flexibility and resilience, are positioned so as to extend from side to side of the device 300, the forward one of these extending from the upper edges of the wall portions 354 associated with the three forward frames 330 in an upwardly arched configuration to corresponding locations at the wall portion 354 associated with the rearwardly positioned frames 330. Similarly, the rear screen 375 extends in upwardly arched configuration from the upper edge of the wall portions 354 of the rearwardly disposed frames 330 to the upper edges of the end pieces 356. These screens 375 thus define substantially closed spaces 377 above the forwardly positioned openings 16 and the following strip 350 and above the rearwardly disposed openings 16 and the following strip 350. If desired, these spaces may be closed at the sides thereof such as by further mesh material. The screens have been found effective to trap within the spaces 377 debris collected during operation of the apparatus. Preferably they are arranged to be easily removable such as by use of suitable releasable fasteners to facilitate removal of debris, or debris may simply be slipped sidewardly off the device 10 through open ended spaces 377. In alternative arrangements, the screens may be formed of material which is flexible and non resilient or may form substantially rigid cages on top of the device.

Figure 8:
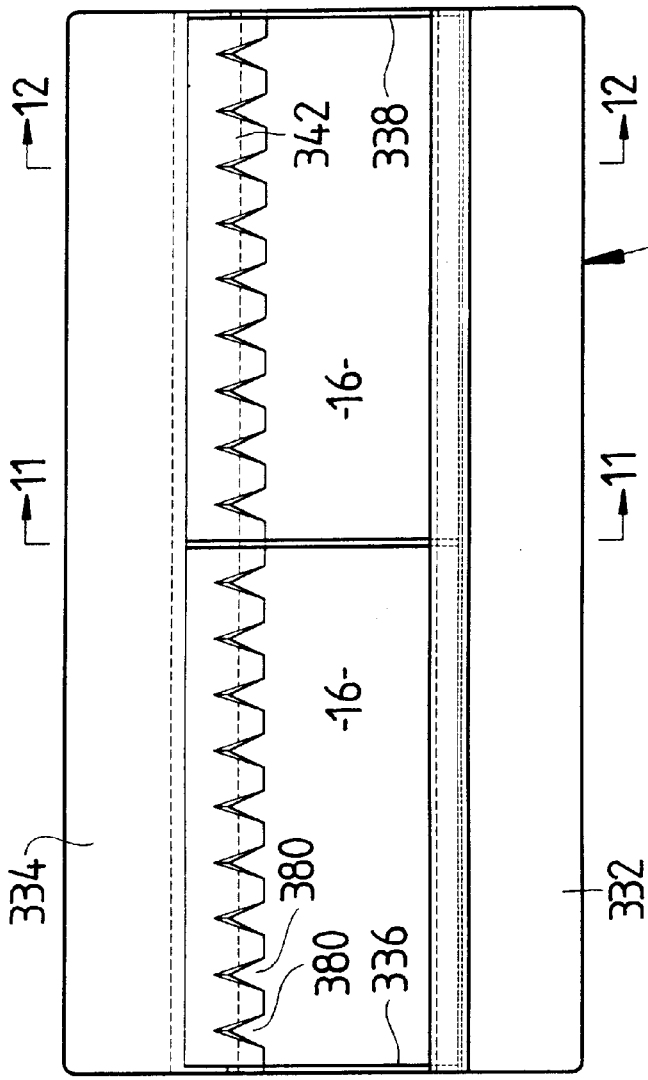
FIG. 8 is a plan view of a further embodiment of the invention.
Figure 10:
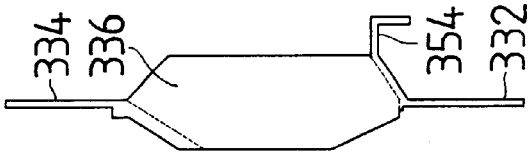
FIG. 10 is an end view of the embodiment of FIG. 8.
Figure 9:
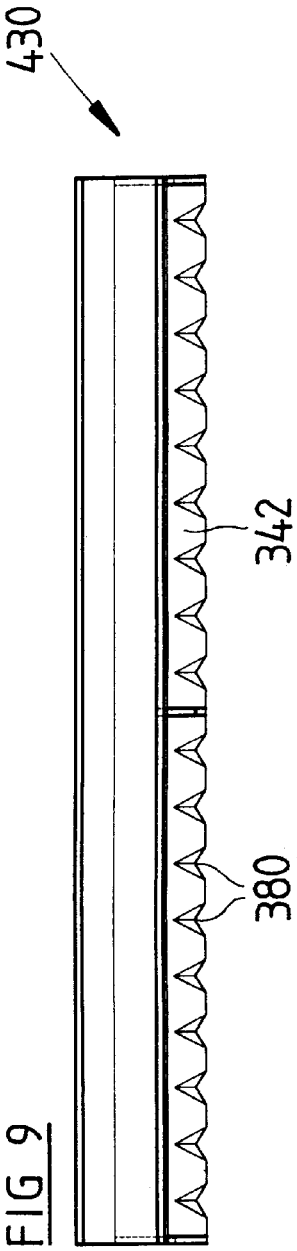
FIG. 9 is a front view of the embodiment of FIG. 8.
Figure 16:
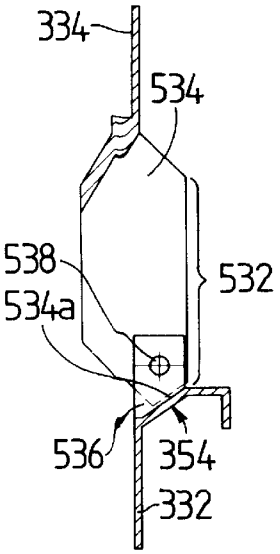
FIG. 16 is a cross-section on the line 16—16 in FIG. 13.
Figure 13:
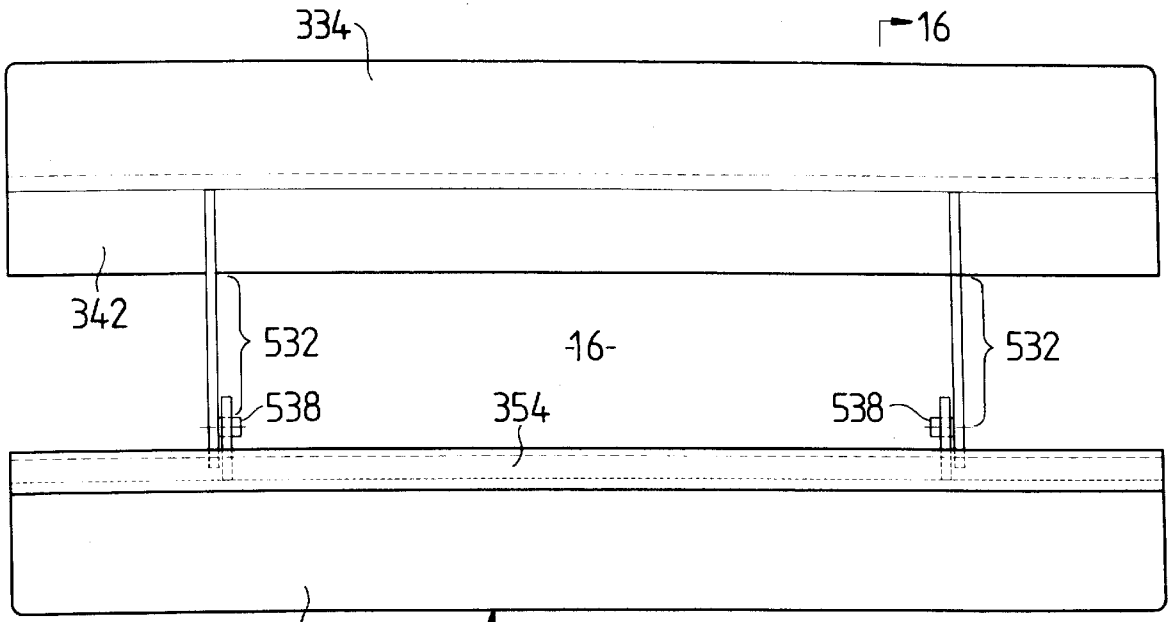
FIG. 13 is a plan view of a further embodiment of the invention.
Figure 14:
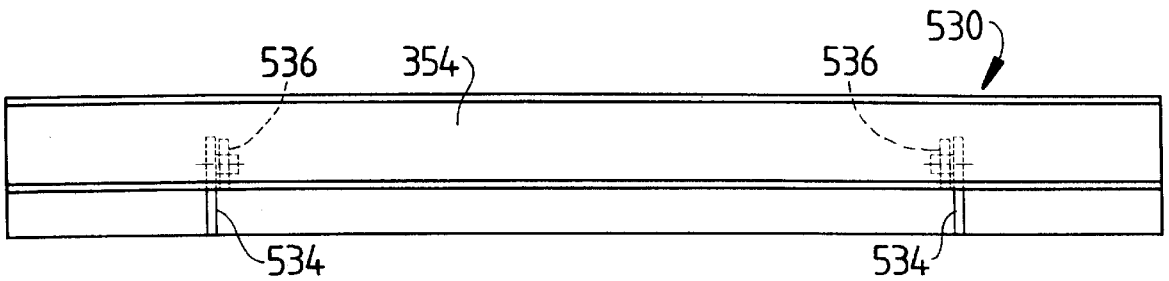
FIG. 14 is a front view of the embodiment of FIG. 13.
Figure 15:
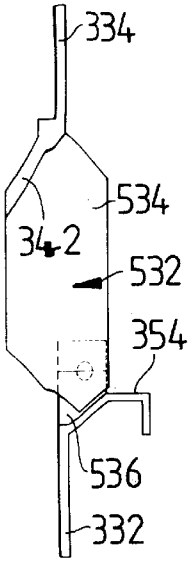
FIG. 15 is an end view of the embodiment of FIG. 13.

FIGS. 8 and 9 illustrate a modified frame 430 similar to the frame 430. FIGS. 9 to 12, like reference numerals denote like components in FIGS. 6 and 7. Here, however, the angled pick-up portions 342 are of scalloped form, being provided with V-shaped notches 380 at forward edges to facilitate the pickup of debris.

FIGS. 13 to 16 illustrate a still further modified frame 530. Again, this generally similar to the frame 330 described in relation to FIGS. 6 and 7. Like reference numerals denote like components in FIGS. 6 & 7 and 13 to 16 and the following description is confined to differences as between frames of FIGS. 6 and 7 and of FIGS. 13 to 16.

In the frame 530, walls 336, 338 & 340 are removed, and replaced by jointed wall structures 532. Each wall structure 532 has a first portion 534 extending forwardly from the rear wall portion 334 and generally configured like the walls 338 previously described. The portions 534 terminate short of the wall portion 354 and forward portion 332 but are jointed to rearwardly extending flange portions 536 of wall structures 532 by means of pins 538. In this fashion, each wall portion 534 and the flange portion may rotate one relative to the other about the axes of the pins 538 so as to permit pivotal movement of the forward and rear parts of the frame. Thus, the strips 350 carried by these may likewise pivot about side to side axes of the device as a whole.

As shown, wall portion 354 of each frame 530 may have an upwardly and rearwardly extending portion 354*a* extending from portion 332, and the wall portion 534 may have somewhat correspondingly angled edge 534*a* which has only a relatively small clearance relative to the portion 8 534*a* so as to somewhat limit the amount of permitted movement as between the forward and rearwardly disposed parts of the frame 530.

The described devices have been found to be particularly satisfactory for cleaning debris from hard surfaces such as asphalt, concrete or the like, as well as from grass and similar surfaces. It has also been found satisfactory for use in collecting small items such as nuts, bolts or the like. With rough asphalt in particular, the collecting action is very efficient, the bristles 14 acting to clean the ground surface, directing debris to the upper surface of the device.

In one form of the invention, it was found satisfactory to provide openings 16 of dimensions of the order of 260 mm by 60 mm, with the depth of the pile formed by the bristles 14 being of the order of 1 cm. The sizes may however be varied as necessary to adapt the invention to particular uses. For example, the openings 16 may be of the order of 10 to 300 mm length, measured in the front to rear direction of the device of the invention. At towing speeds of up to 30 Kph, a length of about 70 mm may be satisfactory, with greater lengths being employed with faster towing speeds, for example 100 mm where speeds up to 100 Kph are employed. Similarly, the depth of the pile provided by the bristles 14 may be varied. Generally, the longer the bristles, the better is the wearability, but shorter bristles are generally more efficient, since it is easier to direct objects through a lesser distance from the ground surface to the upper surface of the device. Practically, for small objects such as washers or the like a thickness of about 9 mm may be satisfactory. For large objects, greater depth may be employed. A choice of overall thickness of matting material of 5 to 15 mm will provide satisfactory pick-up of a range of commonly encountered small objects.

The bristles 14 should generally be flexible, and some degree of resilience is also desirable.

In an exemplary construction, the matting material 15 was artificial grass material formed on a base of two thicknesses of thin woven polypropylene material, the bristles 14 being formed of flat polypropylene fibres. The bristles 14 were formed from flat yarn of weight 1332 gram per square metre. The material was sewn on the backing material in loops along rows spaced apart approximately 4 mm. A rubber-like backing was then applied to the woven sheets at the side opposite the loops, and the loops cut to form the bristles as upstanding tufts. Material with 27 loops per 10 cm in each row was found to be satisfactory, the tufts being of length about 9 mm. The resultant matlike structure is somewhat crushable by impression of hand pressure on the bristles, but has sufficient resilient to cause reasonably quick restoration to the original condition when pressure is removed. This artificial grass material is relatively flexible due to the base material (the woven material together with the rubber-like backing) being flexible.

The described artificial matting material presents an undersurface constituted by the bristles which is readily able to conform to local variations in ground surface as the device 10 is passed over the ground surface, in particular being able to conform to surface undulations as well as accommodating small obstacles, and providing an effective sweeping action to agitate debris and cause it to move through the openings 16. While it is preferred that the device include a flexible base with a conformable portion in the form of the described bristles, other constructions are possible. For example, a layer of foamed plastics material could be used. In general, the whole of the device 10 should be flexible, although, particularly if a very thick underlayer constituted by bristles, foam or other material is employed, this could be secured to a relatively rigid upper backing. In the described example of FIGS. 1 and 2, the leading edge of the device is provided with a rigid strip 25 to facilitate maintenance of the device in a spread out condition during towing over a surface.

In general, the dimension of the openings 16 in the front to rear direction of the device may be about the same or slightly greater than the front to rear distance separating adjacent openings 16, although the separation of adjacent openings 16 may be considerably greater. The device may be of any convenient dimensions. A length of the order of one metre and a width of the order of two metres may be satisfactory for general manual use.

The described construction has been advanced merely by way of explanation, and many modifications and variations may be made thereto without departing from the spirit and scope of the invention as defined in the appended claims.

I claim:

1. A device for collecting debris from a surface, comprising a generally planar member having at least a portion thereof defining an undersurface of the device formed of a flexible and locally conformable material, an upper debris-collecting surface of the member being defined by an upper generally planar portion of the member of resilience less than that of the locally conformable material, the member having an opening therein, whereby, when the device is moved over a ground surface with the undersurface in contact with the ground surface the undersurface is caused to locally conform to undulations in the ground surface, and debris on the ground surface passes through the opening to be retained on the debris collecting surface.

2. A device as claimed in claim 1 wherein said portion is formed from a flexible layer.

3. A device as claimed in claim 1 wherein said portion is formed from foam plastics material.

4. A device as claimed in claim 1 wherein said portion is formed from an open mat of sinuous fibres.

5. A device as claimed in claim 1 wherein said conformable material comprises a brush-like structure.

6. A device as claimed in any one of claims 1, 2 and 3 wherein the opening is one of a plurality of openings through the member.

7. A device as claimed in claim 4 or claim 5 wherein the opening is one of a plurality of openings through the member.

8. A device for collecting debris from a surface, comprising a generally planar member having at least a portion thereof defining an undersurface of the device formed of a conformable material such that when the device is moved over a ground surface with the undersurface in contact with the ground surface the undersurface is caused to locally conform to undulations in the ground surface, the device having an opening therethrough whereby, under said movement over a ground surface, debris on the ground surface passes through the opening onto an upper surface of the device, wherein said conformable material comprises artificial grass formed from a flexible backing portion with flexible depending plastics filaments.

9. A devise as claimed in claim 8 having entrapping means for entrapping debris passing through said opening.

10. A device as claimed in claim 8 having a downwardly and forwardly angled pick up portion at the rear edge of the opening.

11. A device as claimed in claim 10 wherein said pick up portion has a scalloped front edge.

12. A device as claimed in claim 8 wherein said opening is substantially surrounded by an open frame to which the conformable material is affixed.

13. A device as claimed in claim 12 wherein said frame is articulated so as to enable parts of the device forward and to the rear of the opening to pivot about a side to side axis.

14. A device as claimed in claim 8 wherein there are a plurality of said openings.

15. A device as claimed in claim 13 wherein said openings extend from side to side of the device.

16. A device as claimed in claim 8 wherein the opening is adjacent an edge of the conformable material.

17. A device for collecting debris from a surface, comprising a generally planar member having at least a portion thereof defining an undersurface of the device formed with depending bristles thereover and the device having an opening therethrough whereby when the device is moved over a ground surface with the bristles in contact therewith debris on the ground surface is passed through the opening to an upper surface of the device, said opening having at a rear edge thereof a forwardly and downwardly depending surface to facilitate pick up of debris.

18. A device as claimed in claim 17 wherein the device is fitted at its upper surface with upstanding projections or ridges.

19. A device as claimed in claim 18 wherein an upstanding wall is formed along a front edge of the opening.

20. A device as claimed in any one of claims 17 to 19 wherein there are a number of openings.

21. A device for collecting debris from a surface, comprising a generally planar member having an opening through the generally planar member whereby, under movement over a ground surface, debris on the ground surface passes through the opening onto an upper surface of the device the device having means for entrapping debris having passed through the opening, the entrapping means includes a flexible mesh material conformed to define a cavity over the upper surface of the generally planar member and encompassing the opening such that a base of the cavity is defined by portion of the upper surface within the cavity and the opening extends forwardly of the direction of travel of the device within the cavity.

22. A device for collecting debris from a surface, comprising a generally planar structure having an upper generally planar portion and, at a lower face thereof, a lower portion defining a conformable undersurface of the structure, the structure having an opening, the conformable material being such that the lower portion is locally crushable by application of local pressure to the undersurface, and resilient to recover substantially to its initial state on removal of the pressure; whereby, when the device is moved over a ground surface with the undersurface in contact with the ground surface the undersurface is caused to locally conform to local undulations in the ground surface and debris on the ground surface is directed by engagement by the lower portion to pass through the opening onto the upper surface of the upper portion to be retained thereon.

23. A device as claimed in claim 22 wherein the opening is one of a plurality of openings through the structure.

24. A device for collecting debris from a surface, comprising a generally planar member having an upper surface and a lower portion which defines a conformable undersurface of the member, the member having an opening, the lower portion being locally crushable by application of local pressure to the undersurface, and resilient to recover substantially to its initial state on removal of said pressure; whereby, when the device is moved over a ground surface with the undersurface in contact with the ground surface the undersurface is caused to locally conform to local undulations in the ground surface and debris on the ground surface is directed by engagement by the lower portion to pass through the opening onto the upper surface for retention thereon.

25. A device as claimed in claim 24 wherein the opening is one of a plurality of openings through the structure.

26. A device for collecting debris from a surface, comprising a generally planar structure having an upper generally planar portion and, at a lower face thereof, a lower portion defining a conformable undersurface of the structure, the structure having an opening, the lower portion locally crushable by application of local pressure to the undersurface, and resilient to recover substantially to its initial state on removal of the pressure; whereby, when the device is moved over a ground surface with the undersurface in contact with the ground surface the undersurface is caused to locally conform to local undulations in the ground surface and debris on the ground surface is directed by engagement by the lower portion to pass through the opening onto the upper surface of the upper portion.

27. A device as claimed in claim 26 wherein the opening is one of a plurality of openings through the structure.

28. A device for collecting debris from a surface, comprising a generally planar mat having at least a portion thereof defining an undersurface of the device formed with depending bristles thereover and the device having an opening therethrough, the bristles being positioned adjacent to the opening, whereby when the device is moved over a ground surface with the bristles in contact therewith, debris on the ground surface is agitated by engagement with the bristles and caused to pass upwardly through the opening to an upper surface of the device for collection thereon.

* * * * *